US009290990B2

(12) United States Patent
Hicks et al.

(10) Patent No.: US 9,290,990 B2
(45) **Date of Patent: *Mar. 22, 2016**

(54) SCREEN ASSEMBLY FOR A WINDOW OR DOOR OPENING

(71) Applicant: Centor Australia Pty Ltd, Queensland (AU)

(72) Inventors: Craig Frederick Hicks, Queensland (AU); Charles Bilek, Queensland (AU); Martin Haberland, Queensland (AU); Nigel Spork, Queensland (AU); Glen Pacholke, Queensland (AU); Robin Simeon, Queensland (AU)

(73) Assignee: CENTOR DESIGN PTY LTD, Queensland (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/841,055

(22) Filed: Mar. 15, 2013

(65) Prior Publication Data

US 2013/0213589 A1 Aug. 22, 2013

Related U.S. Application Data

(62) Division of application No. 12/302,348, filed as application No. PCT/AU2007/000731 on May 25, 2007.

(30) Foreign Application Priority Data

May 26, 2006 (AU) ..... 2006902850

(51) Int. Cl.

| | |
|---|---|
| ***E06B 9/54*** | (2006.01) |
| ***E06B 9/40*** | (2006.01) |
| ***A47G 5/02*** | (2006.01) |

(52) U.S. Cl.

CPC ... *E06B 9/40* (2013.01); *A47G 5/02* (2013.01); *E06B 9/54* (2013.01); *E06B 2009/543* (2013.01)

(58) Field of Classification Search

USPC ..... 160/383, 384, 385, 388, 389, 265, 264, 160/328, 329, 374, 378, 262, 58.1; 296/97.8, 142

IPC .. E06B 2009/2482,2009/2488, 2009/543; B06J 1/2041, 1/2061, 1/2072, 11/02

See application file for complete search history.

(56) References Cited

U.S. PATENT DOCUMENTS

| | | | | | |
|---|---|---|---|---|---|
| 262,398 | A | | 8/1882 | Gerard | |
| 490,448 | A | * | 1/1893 | Lugrin | 160/120 |
| 520,065 | A | * | 5/1894 | Lugrin | 160/122 |
| 1,121,898 | A | * | 12/1914 | Davis | 160/265 |
| 1,134,326 | A | | 4/1915 | Gambon | |

(Continued)

FOREIGN PATENT DOCUMENTS

| | | |
|---|---|---|
| BE | 902207 | 8/1985 |
| CA | 2027827 | 4/1991 |

(Continued)

OTHER PUBLICATIONS

U.S. Appl. No. 11/343,326, filed Apr. 6, 1915, J.M. Gambon.

*Primary Examiner* — David Purol
(74) *Attorney, Agent, or Firm* — Wells St. John P.S.

(57) ABSTRACT

A flexible screen material can be cut out of square, or part of the screen frame can be formed out of square such that when the screen is fitted to the screen frame, there is less sagging.

14 Claims, 15 Drawing Sheets

(56) References Cited

U.S. PATENT DOCUMENTS

| | | | | |
|---|---|---|---|---|
| 1,330,447 | A | 2/1920 | Jacques | |
| 1,385,131 | A * | 7/1921 | Horn | 160/262 |
| 1,594,812 | A | 8/1926 | Blackburn | |
| 1,760,612 | A * | 5/1930 | Trott | 160/216 |
| 2,013,500 | A | 9/1935 | O'Connor | |
| 3,386,489 | A * | 6/1968 | Denton et al. | 160/25 |
| 4,406,519 | A | 9/1983 | Shaw | |
| 4,691,753 | A | 9/1987 | Baier | |
| 4,819,295 | A | 4/1989 | Kaftan | |
| 4,823,859 | A * | 4/1989 | Park | 160/370.22 |
| 5,390,596 | A * | 2/1995 | Farr | 101/129 |
| 5,522,314 | A * | 6/1996 | Newman, Jr. | 101/128.4 |
| 5,659,999 | A | 8/1997 | Benson | |
| 5,758,704 | A | 6/1998 | Elrod | |
| 6,742,565 | B2 * | 6/2004 | Badley | 160/378 |
| 6,938,666 | B1 | 9/2005 | Ulriksen et al. | |
| 7,710,646 | B2 * | 5/2010 | Stewart et al. | 359/450 |
| 2004/0154758 | A1 | 8/2004 | Cheng et al. | |
| 2005/0051283 | A1 | 3/2005 | Chatellard et al. | |
| 2005/0077017 | A1 | 4/2005 | Ramsey | |
| 2005/0161175 | A1 | 7/2005 | Tussinger | |
| 2006/0090858 | A1 * | 5/2006 | Heidenreich | 160/68 |
| 2008/0062516 | A1 | 3/2008 | Stewart et al. | |
| 2008/0163988 | A1 | 7/2008 | Hicks et al. | |

FOREIGN PATENT DOCUMENTS

| | | |
|---|---|---|
| CN | 2237105 | 10/1996 |
| DE | 3936913 | 5/1991 |
| DE | 19807541 | 7/1999 |
| EP | 0207040 | 12/1986 |
| EP | 0429898 | 6/1991 |
| EP | 0911476 B1 | 10/1997 |
| EP | 0911476 A1 | 4/1999 |
| EP | 07718977 | 11/2012 |
| EP | 13179466 | 12/2013 |
| FR | 2546226 | 11/1984 |
| FR | 2558518 | 7/1985 |
| FR | 2563860 | 11/1985 |
| FR | 2594173 | 8/1987 |
| FR | 28886372 | 7/1993 |
| JP | 9303068 | 11/1997 |
| JP | 10072988 | 3/1998 |
| WO | WO87/04485 | 7/1987 |
| WO | PCT/AU2007/000731 | 8/2007 |
| WO | PCT/AU2007/000731 | 2/2008 |
| WO | PCT/AU2007/000731 | 5/2008 |

* cited by examiner

FIG. 14A
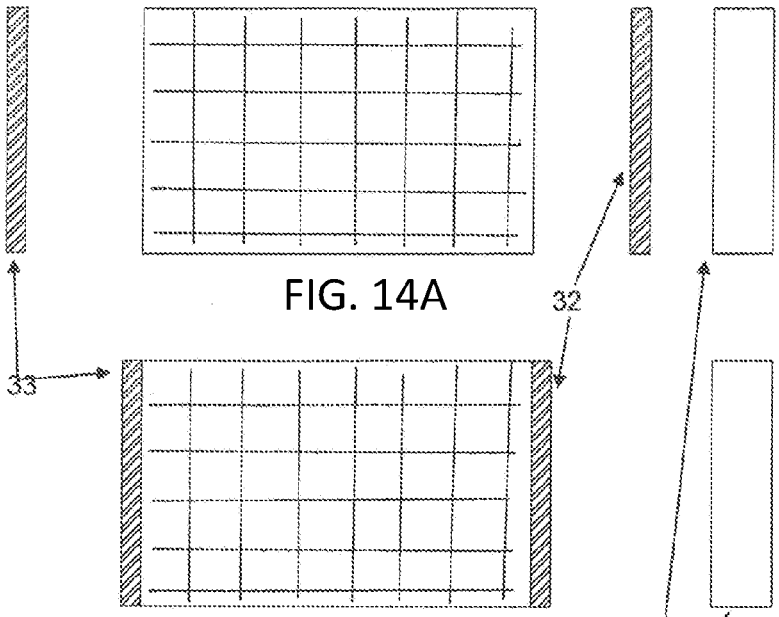
FIG. 14B
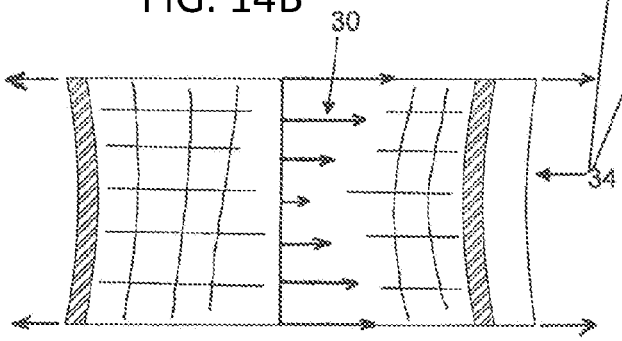
FIG. 14C
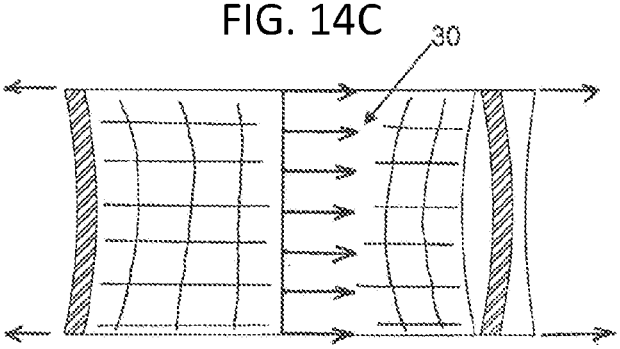
FIG. 14D

SCREEN ASSEMBLY FOR A WINDOW OR DOOR OPENING

RELATED PATENT DATA

This patent resulted from a divisional of U.S. Patent Application Ser. No. 12/302,348, which was filed Sep. 23, 2009, which is a 35 U.S.C. §371 Application of and claims priority to International Application No. PCT/AU2007/000731, which was filed on May 25, 2007, and which claims priority to Australian Application No. 2006902850, which was filed May 26, 2006, and wherein all disclosures of the applications are incorporated herein by reference.

FIELD OF THE INVENTION

This invention is directed to a screen assembly for a window or door opening/cavity and particularly a screen assembly of a special construction to allow a large flexible membrane (screen) to be held taut and with reduced sagging, The invention is particularly directed to a design that enables a screen material to retain an attractive "flat" appearance when suspended across an opening.

The invention will be described with reference to a window or door screen assembly (for instance an insect screen, solar control screen or blind) where the screen material is supported only at its vertical edges with the top (upper) edge and the bottom (lower) edge of the screen material not being attached to any surround frame. This type of screen finds particular use with a large open areas, however it should be appreciated that no particular limitation should be placed on the invention merely by this particular reference.

BACKGROUND ART

It is well known to provide a roll up, or retractable screen assembly that can extend across a window or door opening. In most cases, a flexible screen is wound about a wooden, metal or plastic rod or pole which is positioned in a substantially horizontal manner such that the screen assembly can be pulled up or pulled down. A Holland blind is an example of this type of screen assembly.

It is also known to provide a retractable screen assembly that can move sideways across a window or door cavity, and with this type of assembly, the screen (for instance a mesh) can be wound about a substantially vertical rod or pole (typically located at one side of the cavity).

There is a general requirement that the flexible screen is placed under tension to keep it relatively taut when pulled from the retracted position to the extended position. For vertically moving (that is up and down moving) screen assemblies, this can be achieved by providing some type of weight on the bottom edge rail of the screen. However, for horizontally moving screen assemblies, this cannot be easily done, as attachment of a rail to the lower edge of the screen will prevent the screen from being rolled up about the vertical rod.

It is not satisfactory to simply turn a vertically moving screen assembly on its side to make a horizontally (sideways) moving screen assembly. For instance, one disadvantage is that gravity cannot be used to tension the screen material (as is the case with vertically moving screens). Another disadvantage is that the screen material has a tendency to sag as it is pulled across which is unsightly and can create gaps and openings and damage to the mechanism.

A sideways moving screen which has a desirable configuration is one which has a flexible screen material (for example, an insect screen material) wound about a vertical rod and which can be pulled across a window or door opening. Because the screen material is wound about the rod, it cannot be attached to upper and lower horizontal frame members. Instead the screen material is attached at one vertical edge to the rod (the rod can be called the "second edge member"), and at the other vertical edge to a stile (the stile can be called the " first edge member"). The top and bottom edges are free.

A disadvantage with the construction of a large piece of screen material (e.g. fabric) supported on only two edges (that is with the other two edges largely unsupported) is that the fabric between the edge members is subject to the effects of gravity and will sag under its own weight. Many fabrics are made from individual strands of the base material woven together to make one coherent piece. Insect screening is one such example as are various types of shade screen materials.

The screen material has substantially horizontally orientated longitudinal fibres which extend from one edge member to the other edge member.

It is extremely desirable that the screen material (and particularly the longitudinal fibres) does not exhibit any sagging especially when extended across large window or door openings. The screen material should maintain an attractive "flat" appearance.

This is usually achieved by providing a tensioning means (typically a spring or weight associated with the rod) to tension the screen material to keep is taut and flat.

One desirable object of the present invention is aimed at means of keeping a flat appearance in a piece of fabric that is supported by edge members on only two opposing edges, these edge members being a substantial distance apart—typically 1.5 meters or more.

With vertically operating screens (up and down movement), the lower horizontal edge can be attached to a weighted bottom rail to provide relatively even tension in the fabric and thus achieve a flat appearance. However with sideways (horizontally) moving screens, upper and lower rails (frame members) are not possible and the screen material has a tendency to sag, and to reduce the sagging, various attempts have been made to provide tension in the screen material.

A known solution to provide tension with horizontally moving screen assemblies is to provide some form of spring to maintain tension in the screen material. The spring can be placed within a hollow tube about which the screen material is wound.

Extension (unrolling) of the screen material from the tube causes the spring to be increasingly "wound up" to create tension (a "pullback" force) in the screen material.

A disadvantage with this arrangement is that the amount of tension increases as more of the screen material is unwound from the tube. This means that it can become progressively more difficult to pull the screen material further across the window or door cavity from one side to the other. It should be appreciated that one use of the screen assembly is across rather large door cavities that can have a length of between 3-6 m, and usually contain bifold doors, multi-sliding doors or French doors that have a length of 1.2-2 m. Thus, it can become very difficult to pull a screen across the door cavity as the tension can become too large—especially with a single screen spanning 2 m or more. If the tension is reduced to compensate, the screen material can sag due to insufficient tension, or have sag lines.

Another disadvantage with the above type of arrangement is that the increasing tension can cause damage (for instance premature stretching) of the screen material, especially if the screen material is relatively flimsy. There is an advantage in having screen material which is relatively thin (and therefore may be somewhat flimsy), as it allows a greater length of material to be wound about the tube without making the diameter to large to be neatly hidden away in one side of the cavity.

An attempted solution to this problem has been to introduce some form of brake. However, any form of brake can increase the number of parts in the assembly, and require constant maintenance and possible replacement, can fail under wet conditions or if debris or grime come into contact with the brake, and therefore the concept of having some form of brake is generally undesirable It is also known to try to balance the tension on the screen, in essence, to try to reduce the increasing tension force as the screen is pulled across the window or door cavity. Various arrangements of counterweights have been tried to provide some type of balance to the tension force. These counterweights may comprise a weighted rod attached to the end of a line member. Other arrangements use various types of "counter" spring arrangements to provide a balance.

A disadvantage with the use of counterweights is the problem with inertia. To explain, when the screen is in the extended position, and typically pulled across the window or door cavity and latched to the other side, if it is desired to open the screen by pulling the screen partially back away from the other side of the window and door cavity, doing so will cause acceleration or deceleration of the counterweights, and the consequence of this is that the screen will always feel "heavy" to operate quickly which is quite undesirable.

A disadvantage with the use of a "counter" spring is that the spring can only produce a complete neutralisation or balance of the tension at only one extended position. Put differently, with the use of a counter spring, the screen can be pulled across and pulled back more easily than without a counter spring, but if the screen is let go, the "balance" position will be somewhere across the door or window cavity. While this arrangement has some advantages, there is still the general disadvantage that there will always be some resistance to movement of the screen across the window or door cavity except at the one particular "balance" point. It is generally not possible to vary the counter spring in a continuous manner such that the screen is always balanced no matter where the screen is across the door cavity.

It is also known to provide a screen that can be pulled across a door or window or other type of cavity and where there is also provided a line member and pulleys etc to assist in the extension and the retraction of the screen. For a horizontally extending screen, it is known to have a vertical rod, typically at one end of the cavity, and about which to screen material can be wound/unwound, and pulleys or similar devices at the other end of the cavity, with a line member (typically a steel wire, plastic wire etc) connecting the various parts.

As mentioned previously, there are many instances where it is desirable to have a rather large flexible screen (for instance an insect screen) which can cover a rather large area but where there is an advantage in being able to retract the screen. This type of assembly is useful for a "flexible" screen door. The door can be slightly opened to allow passage, and opening and closing of the flexible screen door results in the screen material being wound onto and off a roll. This type of arrangement is known. It is found that the flexible mesh (e.g. insect screen) is susceptible to a degree of sag at least in the top of the screen. It is found that the sag becomes progressively more pronounced as the screen is made larger. For some small screen doors, the sag, while being present, is not very pronounced, but for larger screen doors (and of course other types of flexible membranes or members), the sagging can become pronounced.

In respect of high-quality and expensive screen arrangements, any sag or "soft spots" in the mesh is highly undesirable and must be controlled or eliminated if at all possible.

It is found that simply increasing the tension in the flexible material is not a total solution as it can cause damage to the material, and it is found that for larger screen areas, even a high degree of tension does not overcome sag zones or soft spots in the mesh.

One key element in achieving a flat appearance in a wide expanse of fabric supported on only two opposing edges is to ensure that all fibres that span between the two supporting edges are essentially in one plane and parallel. A fibre with little or no inherent stiffness suspended between two points will hang in a particular shape known as a Catenary (see FIG. 7). If inherent stiffness is ignored, the exact shape of the hanging fibre is dependent upon its own weight (acting under gravity) and the tension in the fibre.

Because the fibres in a piece of fabric in a vertical orientation all tend to hang in such a Catenary shape between the vertical edge supports, to ensure a flat appearance it is important to get the tension in the fibres to be as close to uniform as possible so that the fibres will hang parallel and in the one plane. If for example the bottom fibres were under higher tension and the fibres above them were under lesser tension, the upper fibres would deflect less than the fibres at the bottom and would tend to sit on top of the lower fibres . This phenomenon can result in the upper fibres tending to fall to either side of the lower fibres such that they do not lie in the same plane and this results in the piece of fabric no longer being or looking flat. This can result in soft or sagging spots in the fabric which looks unsightly when the fabric is unfurled (unrolled) and may also result in wrinkling of the cloth when it is rolled up on the rod member.

In the case of a screen product, it is advantageous to have some tension in the flexible membrane so that it does not sag too much. More tension equals less sag, but there are limitations to just how much tension can be applied to the mesh—too much and the strands will break. There are also practical limitations to how to apply substantial tension across a wide span of membrane.

Practical limitations on tension result in a flexible membrane that may sag 25 mm or more across an aperture of 2.5 meters in width. This is a lot of distortion to accommodate, and in most screening products it is important to ensure that the top and bottom edges of the membrane remain covered by an edging strip or inserted into a channel—this will ensure light block out or prevent insects from traveling around the extremities of the membrane. To have an edging strip or channel deep enough to accommodate 25 mm of sag plus a good edge coverage for a safety margin is not very practical, and a method of ensuring a substantially straight edge at the top and bottom of the screen as it rolls in or out and also when it is fully deployed is important.

It is envisaged that the screen material will mostly comprise a woven material which will have longitudinal fibres extending from one side edge of the screen material to the other side edge of the screen material. An insect screen is an example of a woven material. However, it should be appreciated that the present invention is applicable to other screen materials of the type that stretch (even to a small degree) and therefore have dead spots or sag spots in the screen material. These materials may comprise non-woven screens such as plastic sheets, some types of metallic films and the like.

Therefore, there would be an advantage if it were possible to devise a system that would allow larger (but also including smaller) flexible membranes (e.g. insect screens) to be suitably taut or tensioned over the entire area to eliminate or at least reduce the existence of sag or soft spots.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide a system which can be used to keep flexible material positioned in a generally flat plane and with reduced soft spots or sag areas in the flexible material.

In one form, the invention comprises a screen assembly for a window or door opening, the assembly comprising:

(a) a flexible screen material having opposed side edges and an upper and lower edge, and a multiplicity of longitudinal zones extending between the side edges, these longitudinal zones are generally joined together by transverse zones (in the vertical orientation) such that the screen material is woven or bonded together to form one single piece (b) a first at least substantially rigid edge member to which one opposed edge of the screen material is attached, (c) a second at least substantially rigid edge member to which the other edge of the screen material is attached, (d) the screen able to be rolled onto and off a support, (e) a tensioner to tension the screen material, and, (f) a tension equalizer to provide substantially equivalent tension to the longitudinal zones.

If the screen is a woven screen (e.g. insect screen), the longitudinal zones will comprise longitudinal fibres in the screen.

The term "longitudinal zones" is used as the invention may be applicable to certain types of nonwoven screen materials (e.g. plastic sheet) of the type that can stretch and therefore is susceptible to dead zones or sag zones in the screen material. For these nonwoven screen materials, the term "longitudinal zones" is meant to include imaginary longitudinal bands/strips which extend from one edge to the other edge of the screen material, as these "longitudinal zones" in an engineering manner can function somewhat similarly to longitudinal fibres even though the nonwoven screen material does not contain any longitudinal fibres.

The tension equalizer may be formed by cutting the screen material in a particular manner and/or forming the first and/or the second edge member in a particular manner or by attaching the screen material to the edge member in a particular manner.

The tension equalizer may be formed by cutting the top and/or bottom edge of the mesh (or other flexible material) out of square with the vertical edges.

The tension equalizer may be formed by cutting the side edges of the material out of square.

The tension equalizer may be formed by cutting at least one of the top and bottom edges of the material and at least one of the side edges of the mesh out of square.

In another form, the invention comprises a screen assembly for a window or door opening, the assembly comprising a flexible screen material having opposed edges and longitudinal fibres extending between opposed edges one edge being attached to a first rigid or substantially rigid edge member, the other edge being attached to a second rigid or substantially rigid edge member, and tensioning means to provide equivalent tension to the longitudinal fibres.

The screen material can be cut or otherwise formed with a curve. The curve may be a "concave" curve or a "convex" curve. The radius of curvature may be the same or different.

The screen material may comprise an insect screen, a reflective screen, an insulating screen, a see-through screen, a dark or opaque (block out) screen, combinations and the like. The screen may be made of a single material, a combination of materials, may be made of a single sheet, or a plurality of sheets that are attached together, and it is not considered that any particular limitation should be placed on the invention by the selection of the screen type.

The screen will typically extend across a window or door opening/cavity and will therefore have dimensions to suit. It is also envisaged that the screen may be used in any area which would benefit from such an assembly and not necessarily limited to a window or door opening. The screen will typically have a height of between 1-3 m, and may have a length of between 1-8 m and typically between 1-5 m.

The screen assembly can function as an insect screen, a blind, an awning and the like.

The second at least substantially rigid edge member may comprise a supporting member. Typically, the screen material will be wound about the supporting member.

The supporting member may comprise any suitable member such as a rod, a tube, and the like. The length of the supporting member will typically be dependent on the height of the cavity or opening, in which the assembly will be fitted and is expected that a suitable length will be between 1-3 m. The supporting member may be made of any suitable material such as plastic, wood, metal, composite materials and the like.

The diameter of the supporting member can vary but it is expected that the diameter will be between 1-20 cm. Although it is envisaged that the supporting member will be generally cylindrical, under some circumstances, the supporting member may have a polygonal cross-section such as rectangular, octagonal etc. It is envisaged that the supporting member will be made of a single length of material, although, if considered expedient, the supporting member may be made of a plurality of lengths which are connected together. It is also considered that supporting member may be extendable if desired (for instance telescopic). It is also considered that the term "supporting member" should include anything which can support the otherwise flexible screen material.

The tensioner to tension the screen material may comprise a biasing means. The biasing means may comprise a spring. The spring may comprise a tension spring, a torsion spring and the like. If desired, a plurality of biasing means may be provided which may be connected together or relative to each other or not connected relative to each other. The tensioner may comprise an elastomeric member. The tensioner may be provided adjacent the "free edge" of the screen (the free edge being the edge that is pulled across, as opposed to the edge that is attached to the supporting member). However, it is envisaged that the tensioner may be provided at any other position which may be convenient for installation, inspection, use, manufacturing convenience and the like.

As non-limiting examples, the tensioner may comprise a pair of springs positioned in a suitable stile at the free end of the screen. Alternatively, a single spring may be provided. In a further alternative, the tensioner may be provided adjacent and edge of the "cavity" in which the assembly is used and thus not necessarily in a suitable stile at the free end of the screen. In another non-limiting invention, the tensioner can comprise a counterweight instead of a spring or in addition to a spring.

To enable the screen assembly to allow tension in the screen material and using a relatively simple spring, a counteracting force can be applied using the line member and an arrangement of pulleys etc.

Thus, the screen assembly may comprise a drum positioned adjacent one end of the cavity and adjacent the supporting member which supports the screen, a first return pulley adjacent the upper end of the other end of the cavity, a second pulley adjacent the front edge of the screen, a tensioner adjacent the front edge of the screen, a said line member extending from the drum and about the first return pulley and about the second pulley and attached to, or relative to the tensioner, and a second line member which is joined to the first line member in between the drum and the first return pulley, the second line member extending about the first return pulley, a third return pulley adjacent the lower end of the other end of the cavity, and a fourth pulley adjacent the front edge of the screen, the second line member extending about the third return pulley and the fourth pulley and attached to the tensioner.

It is preferred that the front edge of the screen contains some form of elongate housing (typically vertical) in which the second and the fourth pulleys can be hidden, and which also contains the tensioner. The housing may also contain a latch etc to latch against the other end of the cavity.

It is envisaged that the flexible membrane will be substantially rectangular when viewed perpendicular to its plane or orientation.

It is preferred that at the top and bottom of the rectangular piece of membrane the lines do not go all the way across the full span, but instead terminate at the horizontal edges of the membrane. Thus if this piece of flexible membrane is laid down flat the effect of gravity on the individual line members is removed and the individual line members tend to revert to their original (straight) condition and the top and bottom edges of the membrane form into a reverse of the Catenary shape of the individual line members when hanging under gravity.

It will be appreciated that the shape of the membrane in its relaxed form will bear a relationship to the final installed condition for which the membrane is intended. The type of line members may affect their mass, and the actual tension applied to and the span of the membrane may determine how the shape of the Catenary to be cut into the membrane.

There are many methods that could be used to create the shape of the Catenary, a few non-limiting examples are:

1. Cutting the curved shape using a template over a piece of membrane on a horizontal table
2. Rolling the membrane onto a tube or rod member in the vertical condition—starting with the membrane at its full span, rolling it up and finally cutting both ends of the membrane straight through (with a saw or knife). Cutting right through the membrane and the tube or rod member at the same time will produce a neatly packaged roll of membrane.
3. Feeding membrane from one roll onto the rod or tube member whilst indexing the two rolls relative to each other along the line of their axis'. The indexing would need to follow a relationship which duplicates the Catenary compensation.

It is highly desirable that the top edge and the bottom edge of the mesh material are substantially straight and do not sag. FIG. 17 illustrates mesh material where the top edge in the bottom edge are not straight. It is found that if the mesh material is longer than 1.5 m, the sagging in the top and bottom edges becomes quite significant. This can result in several disadvantages. One disadvantage is that the fabric may not properly wind onto or off the vertical rod to which the fabric is attached. Another disadvantage is that the upper edge in the lower edge of the fabric is typically hidden by a top channel and bottom channel. Although the fabric is not attached to the channel (if it were, the fabric could not be attached to a roll), the top edge is hidden from view by passing into and moving along the top channel and the bottom edge is hidden from view by passing into and moving along the bottom channel. If the bottom edge of the screen sags, it can drag in the bottom channel and become damaged. If the top edge of the screen droops too much it can leave the top channel and there will be gap between the top edge of the screen and the top channel which is unsightly and in the case of an insect screen, would allow insects to pass through the gap etc.

Therefore, there would be an advantage if it were possible to provide a screen material which, in use, would have a substantially straight top edge and a substantially straight bottom edge. There would be a particular advantage if the screen assembly as described above (having the tension equalizer) also has a substantially straight top edge and a substantially straight bottom edge.

Another form of the invention resides in a mesh material wherein the top edge and the bottom edge are formed such that when the mesh material is under tension, the top edge and the bottom edge substantially straight.

BRIEF DESCRIPTION OF THE DRAWINGS

Embodiments of the invention will be described with reference to the following drawings in which:.

FIG. 1. Illustrates an upper portion of the screen assembly particularly illustrating the drum and the screen fully extended.

FIG. 2. Illustrates the view of FIG. 1, with the screen partially extended.

FIG. 3. Illustrates a lower portion of the front edge of the screen and particularly illustrating the third pulley, the fourth pulley and the lower end of the biasing means (the housing being removed on the front edge of the screen for clarity).

FIG. 4. Illustrates an upper portion of the front edge of the screen and particularly illustrating the first return pulley and a second pulley and an upper part of the biasing means which is adjacent the front edge of the screen.

FIG. 5. Illustrates the screen in the retracted position.

FIG. 6. Illustrates the screen in the approximately half extended position.

FIGS. 14*a-d*. Illustrate a solution according to a third embodiment of the invention and wherein one of the edge members provides the tension equalizer.

BEST MODE

Figure 1:
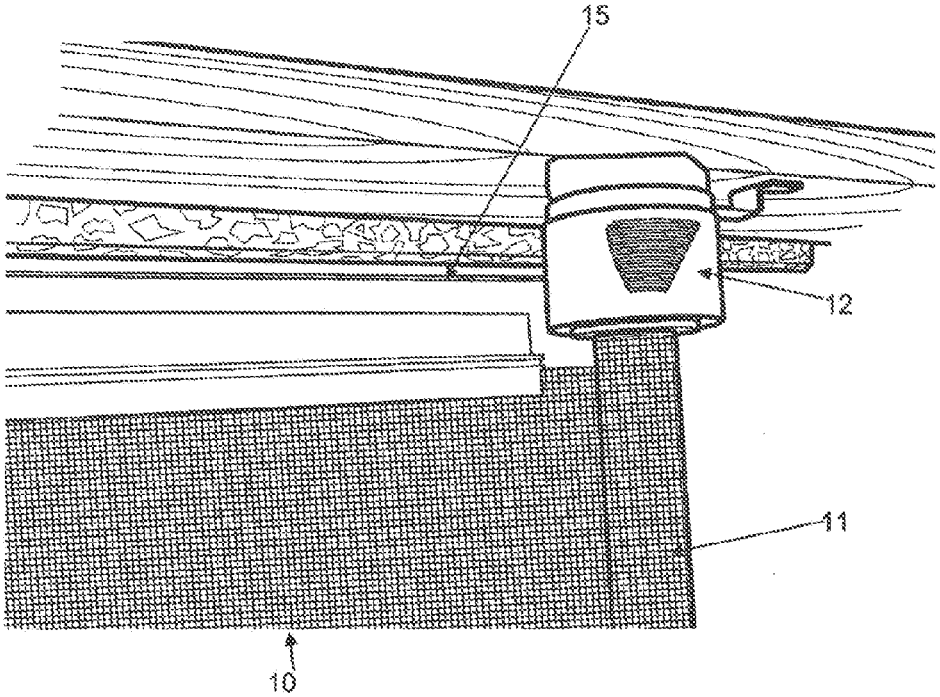
FIGS. 1-6 ILLUSTRATE A PARTICULAR NON-LIMITING TYPE OF LARGE SCREEN ASSEMBLY WHERE THE SCREEN MATERIAL CAN BENEFIT FROM THE TENSION EQUALLIZER OF THE PRESENT INVENTION.
Figure 2:
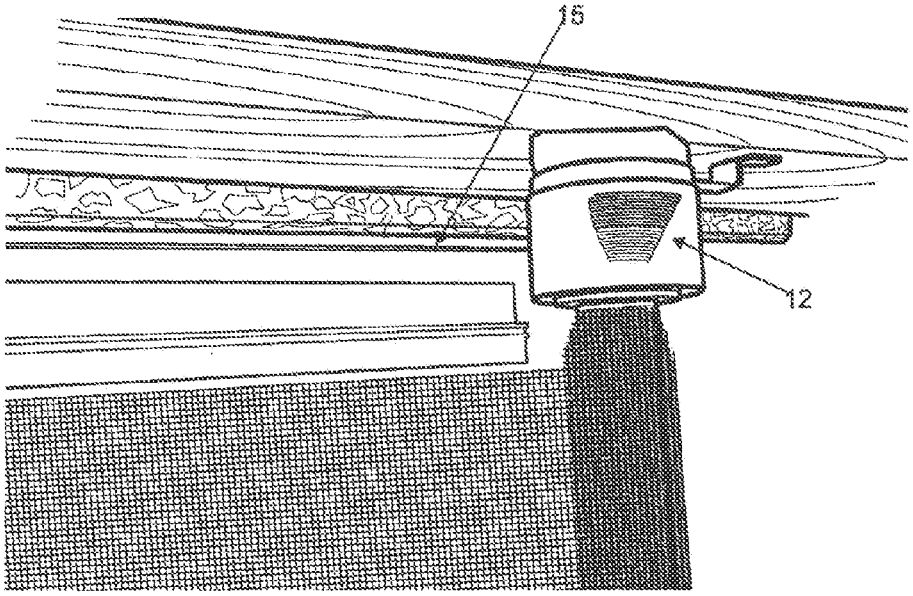
Figure 3:
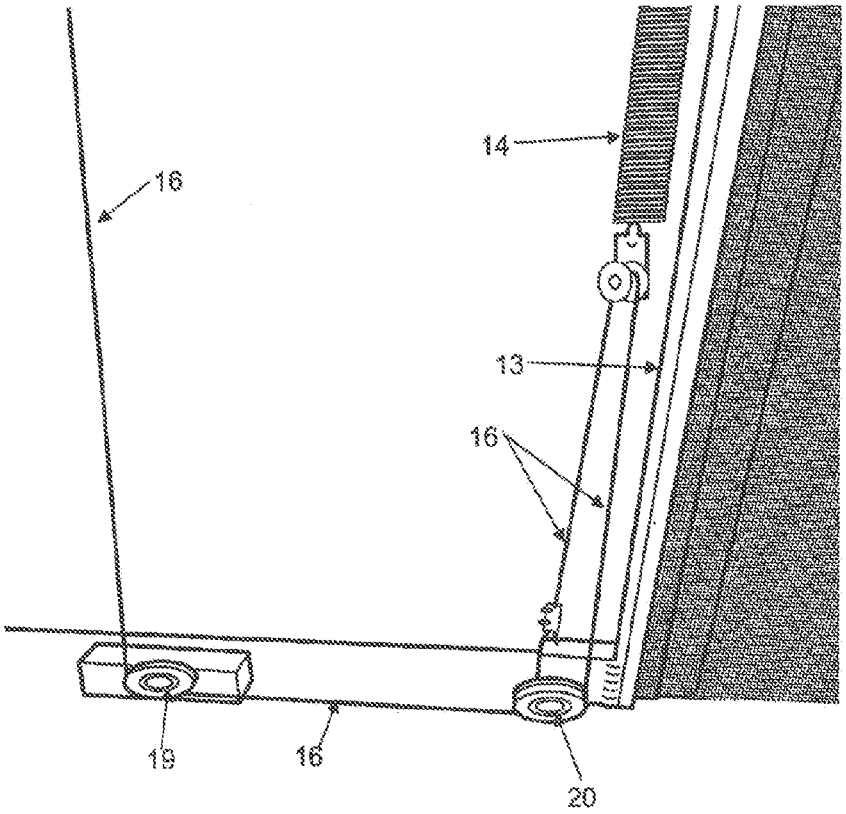
Figure 4:
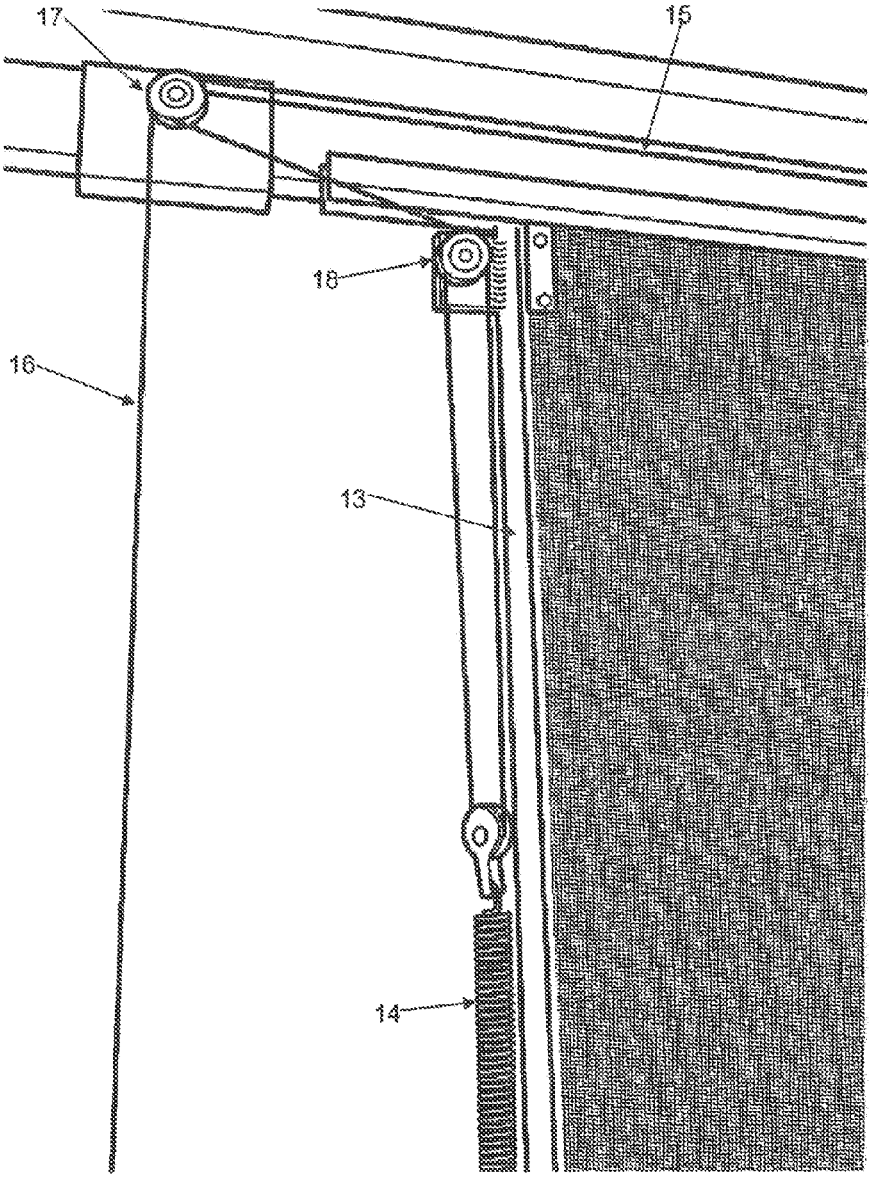
Figure 5:
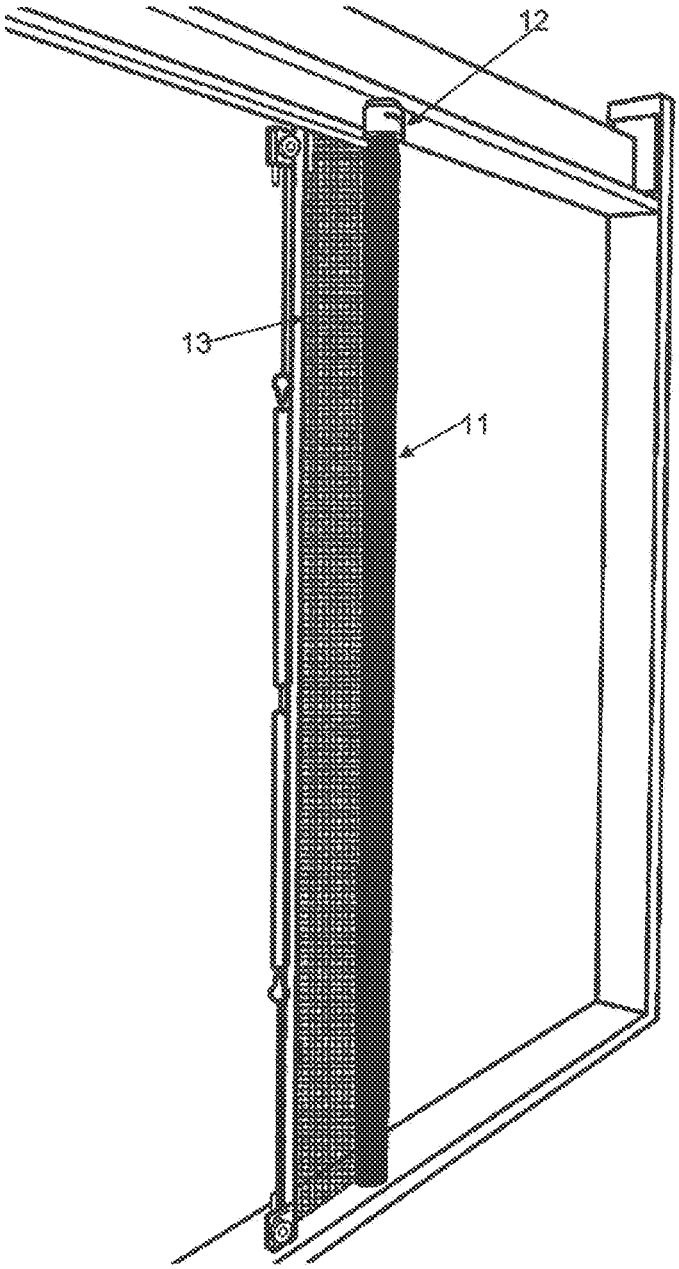
Figure 6:
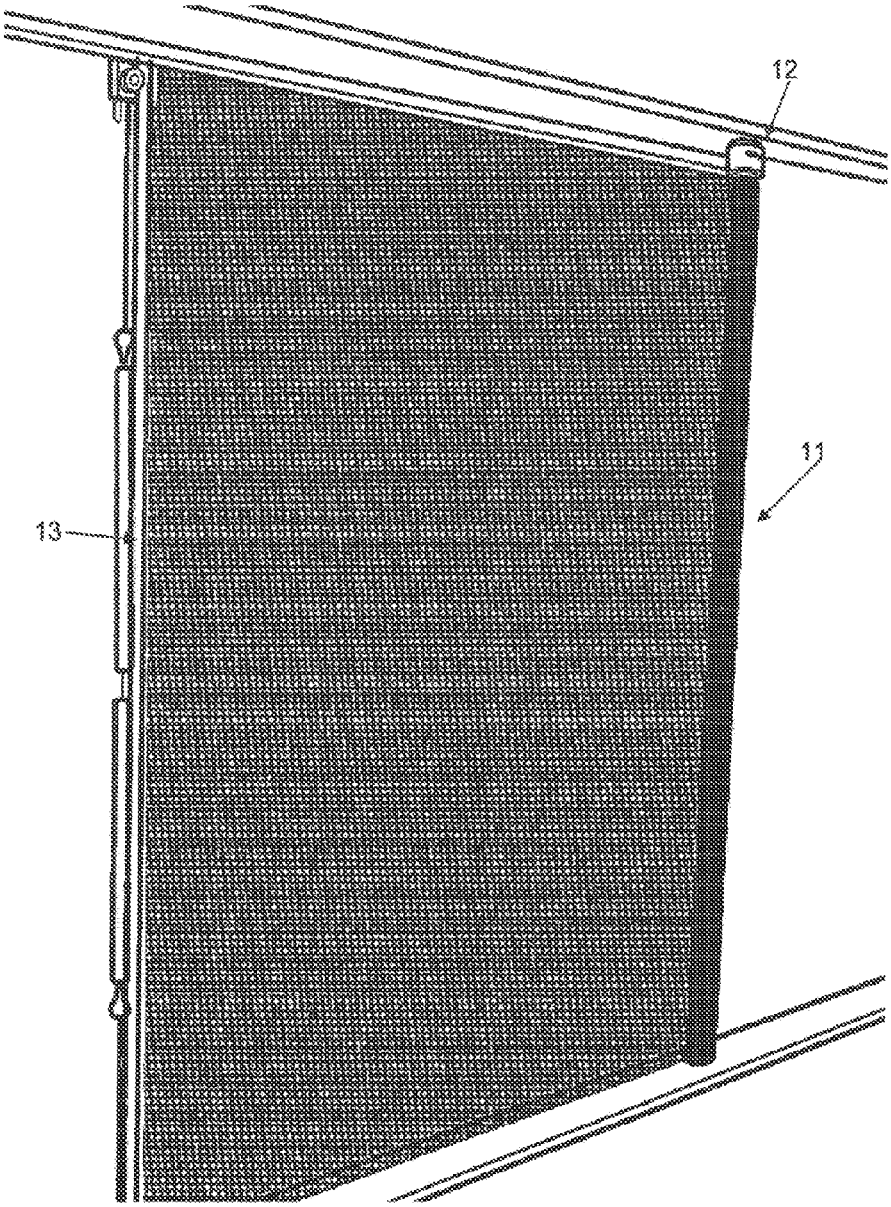

Referring to FIGS. 1-6, these figures illustrates an exemplary type of large screen arrangement where the screen material would be otherwise prone to having sag zones if it were not for the benefit of the present invention. The screen assembly according to the particular embodiment basically comprises the following components: A screen 10, which in the particular embodiment comprises an insect screen, a supporting member (the second at least substantially rigid edge member) 11 about which the screen is wound and unwound, a drum 12 which is positioned in an upper part of the assembly and on top of supporting member 11, a front edge 13 of the screen 10 and which is made of an elongate aluminium section (the first at least substantially rigid edge member), a biasing means 14 (the lower portion being visible in FIG. 3, and the upper portion being visible in FIG. 4), the biasing means being attached to front edge 13, a line member which is split into a first line member 15 and a second line member 16 (this will be described in greater detail below), a first return pulley 17 (FIG. 4), a second pulley 18 (FIG. 4), a third return pulley 19 (FIG. 3) and a fourth pulley 20 (FIG. 3).

The screen assembly as illustrated in FIGS. 1-6 does not clearly illustrate the tension equalizer which is better illustrated in the remaining figures.

Screen 10, in the particular embodiment, can extend between 2-5 m and therefore has this length at least. One end of the screen 10 is attached to the supporting member 11. Supporting member 11 is mounted for rotation about its longitudinal axis such that the screen 10 can be wound and unwound from the supporting member. Importantly, as screen 10 is wound or unwound from the supporting member, the diameter (this being the diameter of the supporting member + any attached screen material) will vary, and will decrease as the screen is unwound and will increase as the screen is wound.

Attached to the top of supporting member 11 is drum 12. In the particular embodiment, drum 12 has a tapered face and is therefore substantially conical. The taper goes from a smaller diameter adjacent the top of the supporting member 11 to a large diameter. It is envisaged that the drum may also be positioned the other way as well. The length of the drum is approximately 3 cm. The widest part of the drum (in the particular embodiment) will be approximately the same diameter as the widest diameter of the supporting member 11+ screen 10 (that is when the screen is fully wound on the drum and is completely retracted), and the narrowest part of the drum (in the particular embodiment) will be approximately the same diameter of the diameter of the supporting member + any remaining screen 10 when the screen has been fully extended, and unwound from the drum.

The first line member 15, which in the particular embodiment comprises a plastic coated steel wire having a diameter of between 1-3 mm, has one end attached to the drum. Therefore, rotation of the drum will cause line member 15 to wind on to the drum or off the drum as the case may be. In the particular embodiment, and because of the cone shape of the drum, the line member will be laid next to each other on the drum. Thus, the diameter of the drum at the point where the line member is wound onto or off the drum will vary because of the conical shape of the drum.

The first line member 15 extends from drum 12 and extends about first return pulley 17 and then about second pulley 18 and is ultimately attached to the upper part of the biasing means 14 which in the particular embodiment comprises a spring. Thus, there is tension in the first line member 15. A second line member 16 is also provided which is formed from the same material as first line member and second line member 16 has one end which is joined to first line member (and therefore branches therefrom) in between drum 12 and first return pulley 17. Second line member 16 then also extends about first return pulley 17 but then extends substantially vertically to extend about third pulley 19, then fourth pulley 20 and is attached to the lower end of biasing means 14. Thus, there is tension in second line member 16.

The biasing means 14, and second pulley 18 and third pulley 19 are all attached to or relative to the front edge 13 of the screen and therefore move with the screen.

In use, as the screen is extended, the first line member will be wound about and onto drum 12. In the particular embodiment, as the line winds onto the drum the line progressively winds from the larger diameter of the drum to the narrower diameter of the drum and therefore the diameter reduces where the line is wound onto the drum. This can be seen with reference to FIG. 1 and FIG. 2. At the same time, the diameter of the support member 11 containing the wound up screen material 10 will decrease as the screen material is unwound, and the construction and arrangement is such that the diameter of the drum is about the same at any one point as the diameter of the support member +any remaining screen material. This will also be the case when the screen is retracted as this will cause the diameter of the support member + screen material to increase and at the same time the line member is being unwound from the drum at progressively increasing diameters.

Figure 7:
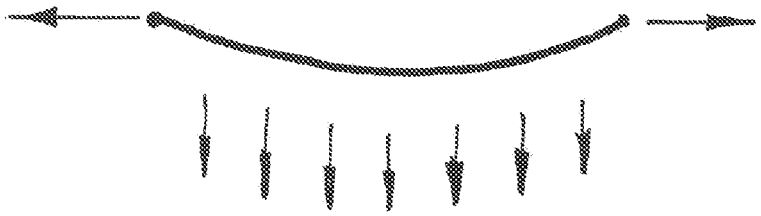
FIG. 7. Illustrates the "Catenary Effect" on a fibre.
Figure 8:
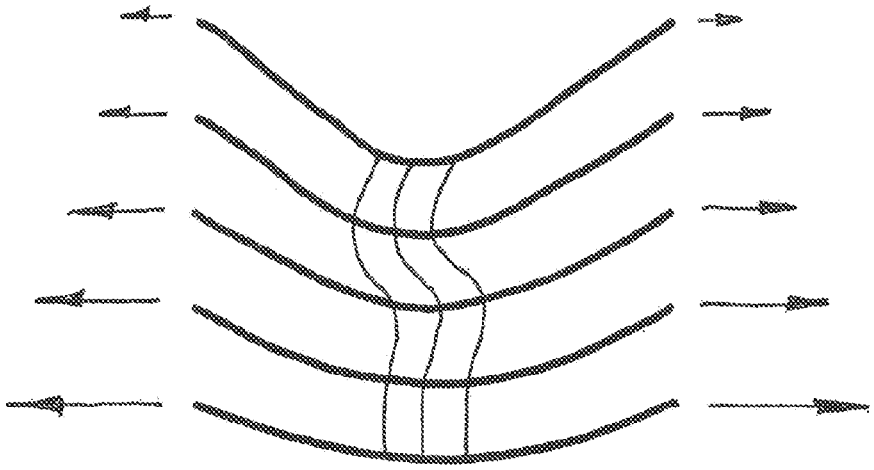
FIG. 8. Illustrates an undesirable sagging effect on the mesh.

A disadvantage with the above type of screen assembly (and other larger screen assemblies) is that even though tension is used (e.g. spring) to tension the screen material, the material still sags under gravity because of the Catenary effect which has been described previously and which is illustrated in FIG. 7 and FIG. 8. This results in the screen mesh not looking attractive and having "sag zones" in the screen mesh. The effect comes about because the rigid edge members are not infinitely stiff and instead do deflect or deform slightly during use. This causes unequal tension in the longitudinal zones/fibres of the screen mesh and this, in turn, causes the sag zones to appear which is not desirable.

The term "zones" is meant to encompass a screen that is not woven and therefore does not contain easily identifiable longitudinal fibres. This type of screen may comprise a plastic sheet and the "longitudinal zones" in the plastic sheet will comprise "imaginary" thin bands/strips extending from one edge to the other edge. A screen comprising a plastic sheet which has some stretch, will benefit from the tension equalizer according to the present invention.

Figure 9:
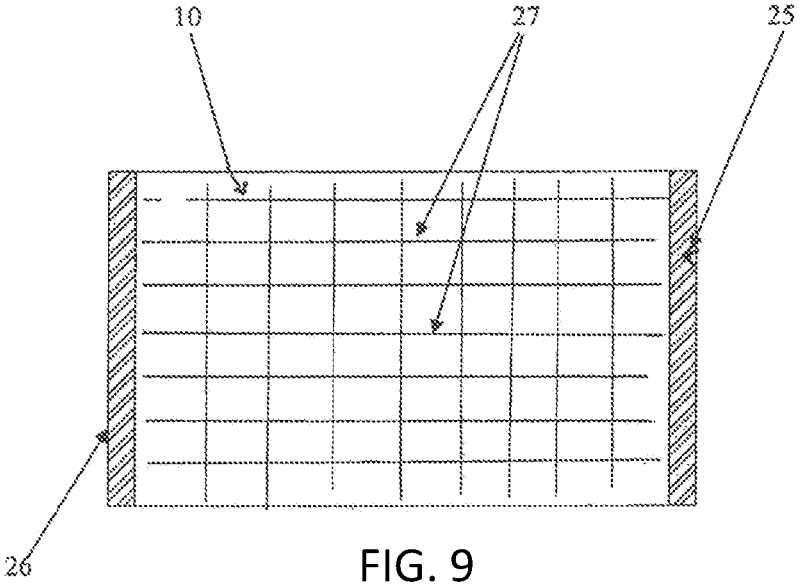
FIG. 9. Illustrates an ideal screen assembly where each rigid each member is infinitely stiff and therefore all the longitudinal zones/fibres are horizontal.

FIG. 9 illustrates schematically an ideal (but not possible) screen assembly where the edge members 25, 26 are infinitely stiff and therefore the longitudinal fibres 27 in the screen material are all horizontal.

Figure 10:
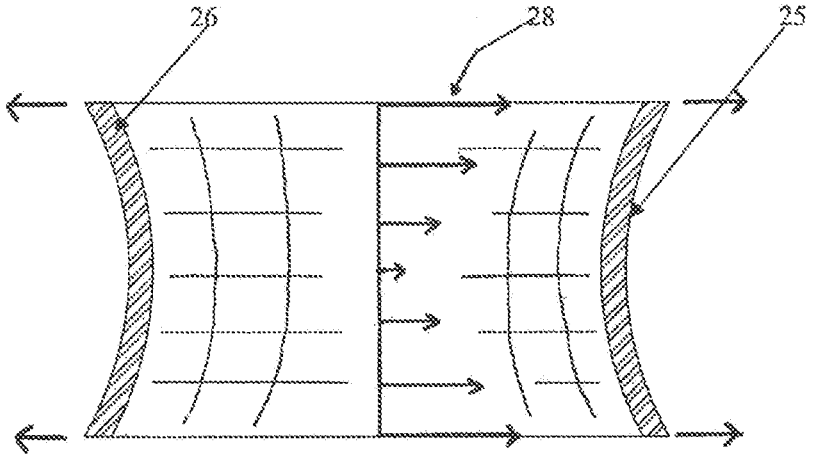
FIG. 10. Illustrates (in an exaggerated mariner) the reality of a large screen assembly where the edge members deform causing unequal tension (and therefore creation of sagging zones) in the longitudinal fibres.

FIG. 10 illustrates schematically the realistic situation in a screen assembly where the edge members 25, 26 deform inwardly slightly (in FIG. 10 the deformation is exaggerated), and the results is that the tension 28 is unequal in the various longitudinal fibres in the screen material resulting in sag zones. Specifically, the tension in the middle longitudinal fibres is less than the tension in the longitudinal fibres which are in an upper area and lower area of the screen material.

Figure 11:
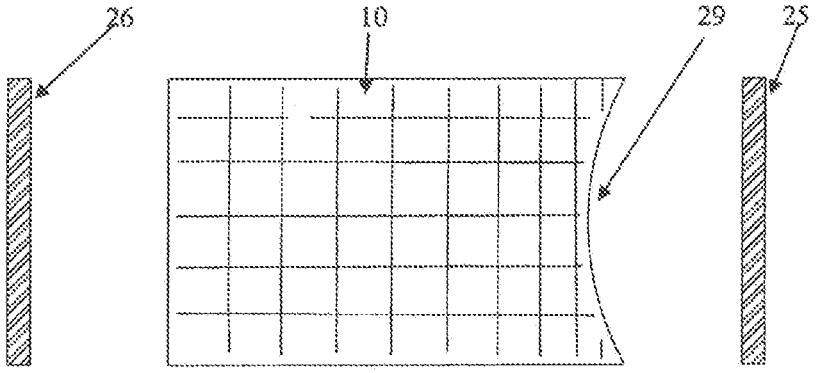
FIG. 11. Illustrates a solution to the sagging of the screen assembly according to a first embodiment whereby one edge of the screen material is concave to provide the tension equalizer.
Figure 12:
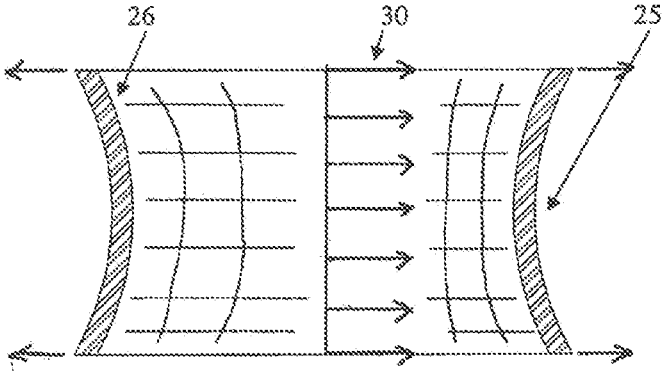
FIG. 12. Illustrates a screen assembly using the solution of the first embodiment and illustrating substantially equivalent tension in the longitudinal fibres thereby preventing sagging zones being formed in the screen material.

FIG. 11 and FIG. 12 illustrate a tension equalizer according to a first embodiment of the invention to provide substantially equivalent tension in the longitudinal fibres of the screen material. Referring initially to FIG. 11, the screen material (fabric) 10 has one vertical side edge 29 cut with a curve such that the middle longitudinal fibres are shorter than the fibres in the upper area and a lower area of the screen material. Each edge member 25, 26 is substantially straight.

When the screen material (fabric) is attached to each edge member, the curvature of side edge 29 accommodates the deforming of the edge members 25, 26 such that the tension (illustrated by arrows 30) in the longitudinal fibres is approximately the same. It will be appreciated that in this and other embodiments following, that the screen material may simply be attached to the edge member in a way which follows the desired shape without actually being cut thus. This is illustrated in FIG. 12.

Figure 13:
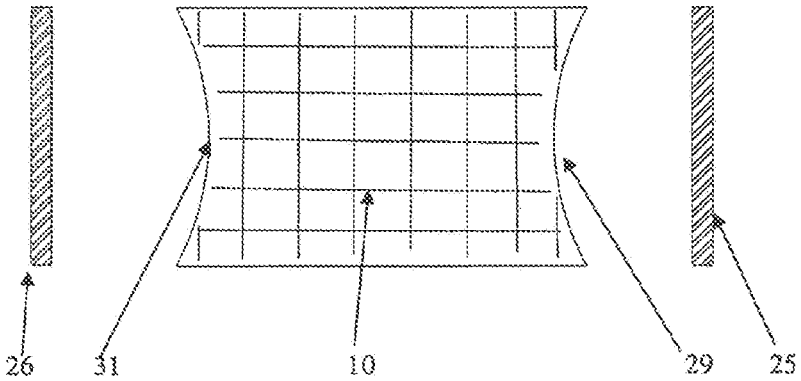
FIG. 13. Illustrates a solution according to a second embodiment of the invention and where both side edges of the screen material are concave to provide the tension equalizer.

FIG. 13 illustrates a tension equalizer according to a second embodiment of the invention. In this embodiment, each side edge of the screen material 10 is cut with a curve (29, 31) such that subsequent attachment to the edge members 25, 26 will result in substantial equivalent tension in each of the longitudinal fibres of the screen material.

FIG. 14*a-d* illustrates a third embodiment of the invention. In this embodiment, the tension equalizer is provided by a specially designed edge member and the screen fabric does not need to be cut into a curve. Specifically, the figures illustrates a rectangular piece of fabric 10 to which are attached two edge members 32, 33 which are roughly parallel to each other. To one edge member 32 is provided a second stiffer edge member 34. A restraining force is then applied to the ends of the edge members and both edge members deflect due to the tension from the fabric. An adjusting means is provided which can comprise shims, adjusting screws or the like to deform edge member 32 to compensate for the deflection and therefore restoring equal tension in the longitudinal fibres.

FIG. 14(*b*) illustrates the edge members 32, 33 attached to the screen 10 but where no tension has yet been applied. FIG. 14(*c*) illustrates tension applied to the screen and showing the unequal tension (arrows 30) in the longitudinal fibres and illustrates the additional stiffer edge member 34 attached but not yet adjusted. FIG. 14(*d*) illustrates how the edge member 32 can be deformed the other way by the use of adjusting screws (or something else) between the edge member 32 and the stiffer edge member 34, and in doing so, results in the creation of substantially equivalent tension in the longitudinal fibres in the screen material 10.

Figure 15:
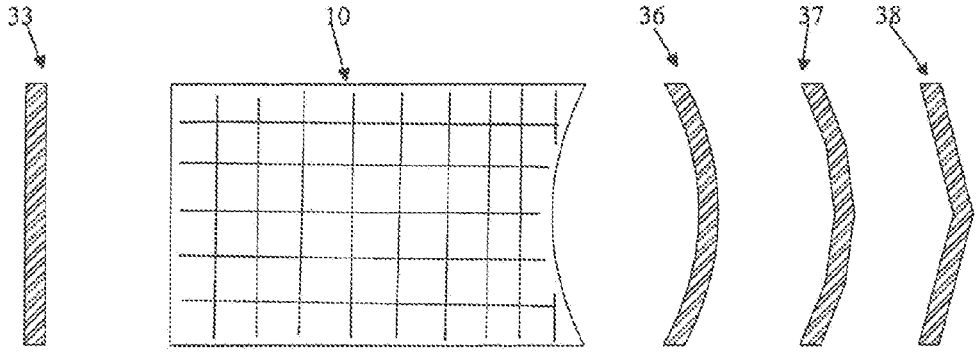
FIGS. 15-16. Illustrates variations in configuration of the edge member to provide the tension equalizer.
Figure 16:
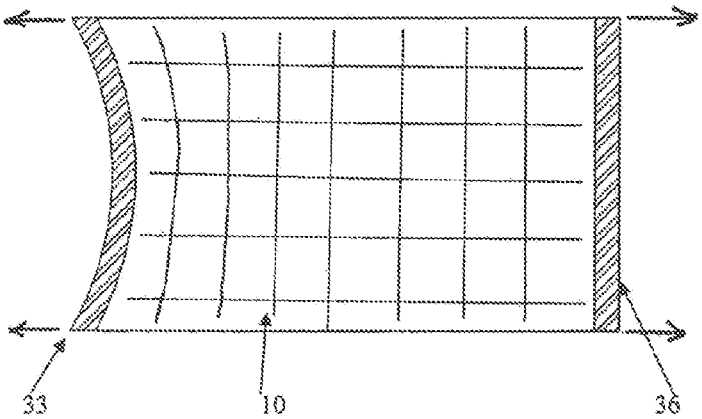

FIG. 15 and FIG. 16 illustrates another embodiment of the invention which can comprise a system where the fabric (screen material 10) is used as a movable screen or blind and where it is desirable for at least one edge member to have a substantially straight edge so that it can align with a second screen or blind or with the edge of a window or door opening (for example). Achieving the straight edge can be achieved by curving or otherwise shaping one edge member (36) such that when the edge member is attached to the screen material and tension load from the fabric is applied to the edge member, the edge member is largely restored to a straight condition (see FIG. 16). The edge member may have the configuration illustrated as reference numeral 36 but may also have different configurations (e.g. 37, 38).

Figure 17:
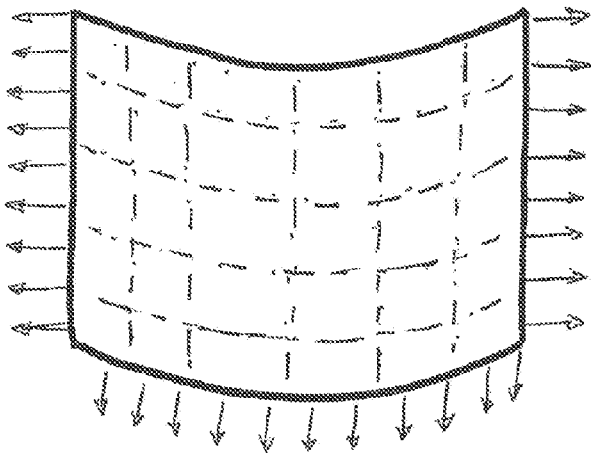
FIG. 17. Illustrates the sagging of the upper horizontal edge and the lower horizontal edge of a screen material (which is undesirable) .

FIGS. 17-26 illustrate various ways to keep the top edge and the bottom edge of the mesh material (fabric) substantially straight. It is highly desirable that the top edge and the bottom edge are substantially straight and do not sag as illustrated in FIG. 17. It is found that if the fabric is longer than 1.5 m, the sagging in the top and bottom edges becomes quite significant. This can result in several disadvantages. One disadvantage is that the fabric may not properly wind onto or off the vertical rod to which the fabric is attached. Another disadvantage is that the upper edge in the lower edge of the fabric is typically hidden by a top channel and bottom channel. Although the fabric is not attached to the channel (if it were, the fabric could not be attached to a roll), the top edge is hidden from view by passing into and moving along the top channel and the bottom edge is hidden from view by passing into and moving along the bottom channel. If the bottom edge of the screen sags, it can drag in the bottom channel and become damaged. If the top edge of the screen droops too much it can leave the top channel and there will be gap between the top edge of the screen and the top channel which is unsightly and in the case of an insect screen, would allow insects to pass through the gap etc.

Therefore, there would be an advantage if it were possible to provide a screen material which, in use, would have a substantially straight top edge and a substantially straight bottom edge. There would be a particular advantage if the screen assembly as described above (having the tension equaliser) also has a substantially straight top edge and a substantially straight bottom edge.

Figure 18:
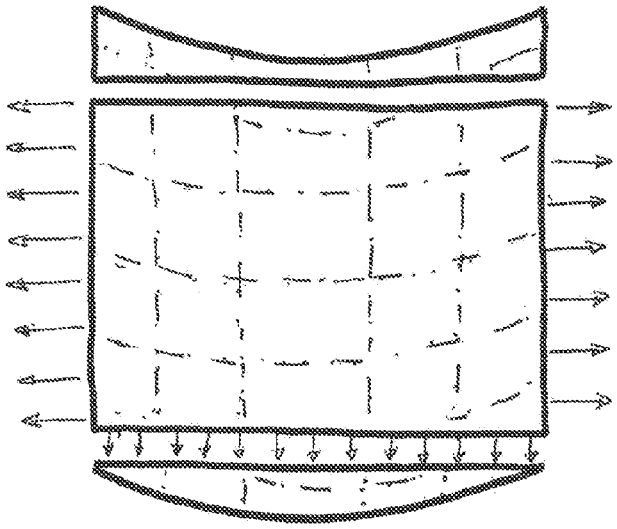
FIG. 18. Illustrates a solution to the sagging of the upper horizontal edge and the lower horizontal edge.

FIG. 18 illustrates a first embodiment which enables the top and bottom edges of the screen material to be straight in the unfurled (rolled up) position, thereby allowing the screen material to roll up in a predictable manner onto the vertical rod member. This would make management of the top and bottom edges of the fabric much more simple. In the embodiment of FIG. 18, this is achieved by cutting the screen material near the top and the bottom and typically for a distance of up to 50 mm or so and because this small amount of screen material is light, the screen material has enough integral stiffness to hold its flatness in these areas. The screen material can be cut to match the Catenary effect in the screen material so that the screen material will always have top and bottom edges at the same position and the screen material will roll up very neatly on the rod member.

Figure 19:
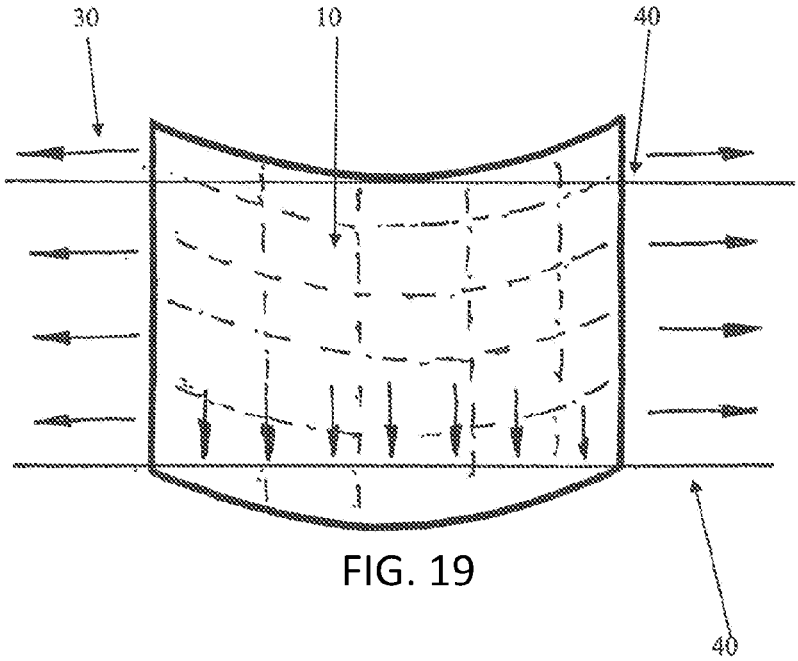
FIG. 19. Illustrates a solution to the sagging of the upper horizontal edge and the lower horizontal edge.

FIG. 19 illustrates one method to enable the screen material to be pre-cut prior to use. The method requires the screen material 10 to be supported vertically with even tension (see arrows 30) applied to the side edges, the tension closely matching the tension load that will be used in practice. This effectively replicates how the screen material will be installed. Once supported vertically, and with the tension adjusted, the top and bottom edges of the fabric can be trimmed off to be straight. Cut lines 40 illustrate this.

Figure 20:
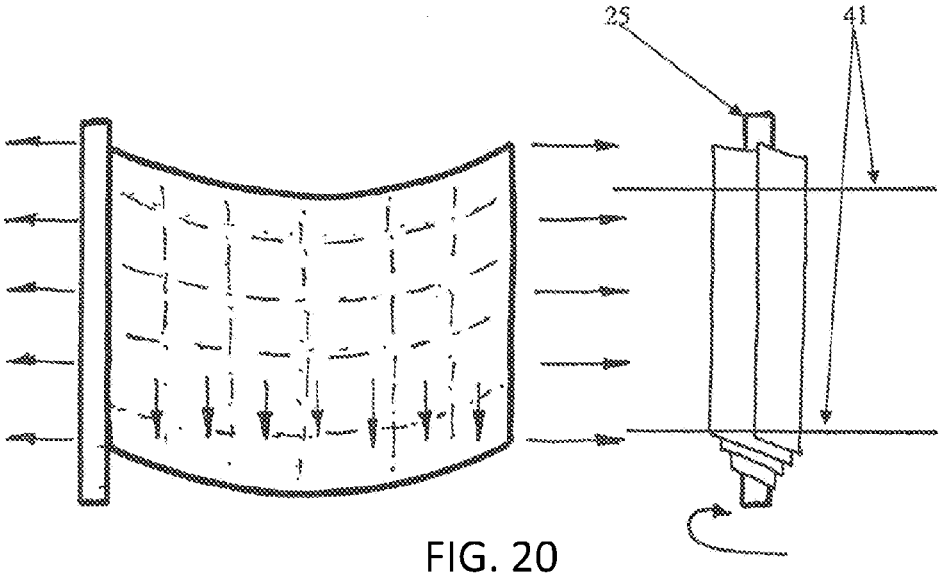
FIG. 20. Illustrates a solution to the sagging of the upper horizontal edge and the lower horizontal edge.

FIG. 20 illustrates an alternative embodiment of the invention. In this method, the mesh material is positioned in the vertical plane so that gravity acts on the screen fabric. This (fabric) 10 is then rolled up on a rod member (second rigid end member 25) while still under tension and then to cut through both the mesh material 10 and the rod member 25. When reinstalled with the edge member is under tension, the top and bottom edges of the mesh material will be straight. Cut lines 41 illustrate this. It will be appreciated that in possible variation of this method, the rod member itself is not cut through.

Figure 21:
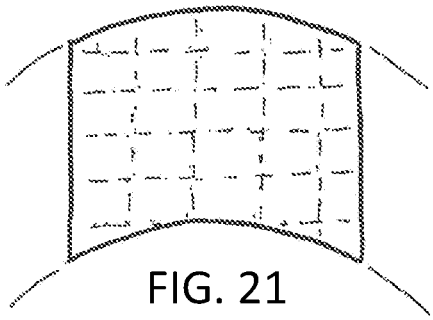
FIG. 21. Illustrates the shape of the screen material with no forces applied and providing a solution to the sagging of the upper horizontal edge and the lower horizontal edge.

When the mesh material is cut according to the alternative embodiment illustrated in FIG. 20, and if the mesh material was laid flat with no forces applied to the mesh material, the shape of the mesh material would be as illustrated in FIG. 21. The fibres of the mesh material will be straight and the top and bottom edges will be curved.

Figure 22:
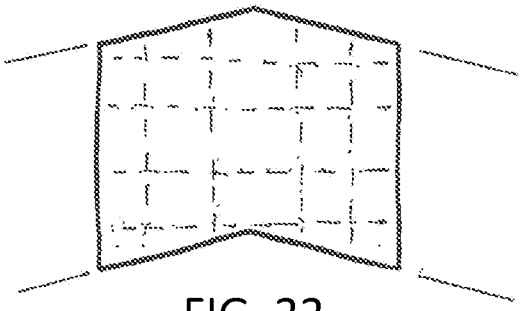
FIGS. 22-26. Illustrate various other shapes of the screen material.
Figure 23:
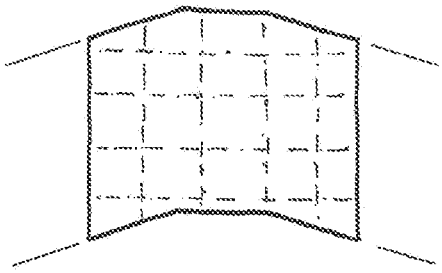

Therefore, rather than using the alternative embodiment illustrated in FIG. 20, it is also possible to pre-cut the mesh material into the desired shape before the mesh material has any forces applied to it. Thus, it is possible to pre-cut the mesh material to the shape illustrated in 21 prior to assembling the screen assembly, and FIG. 22 and FIG. 23 illustrate variations to the shape of the mesh material.

Figure 24:
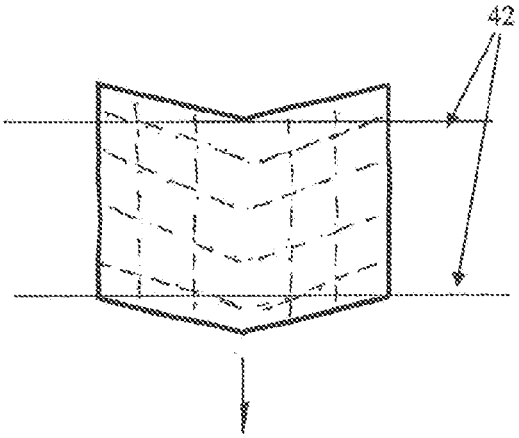
Figure 25:
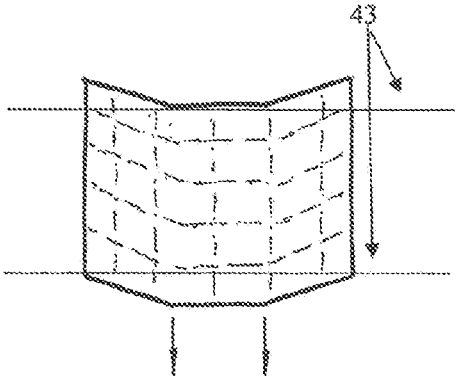

FIGS. 24 and FIG. 25 illustrate an alternative method to precut the mesh material prior to assembling the screen assembly. In this alternative method, the mesh material can be attached to each members (not illustrated) and can be pulled in the direction of the arrow in FIG. 24 and FIG. 25 to approximate the shape that gravity will cause the mesh material to take when in the vertical plane. Simple straight cuts (see cut lines 42 and 43) can then be made at the top and the bottom of the mesh material to create a shape in the top and the bottom edges.

Figure 26:
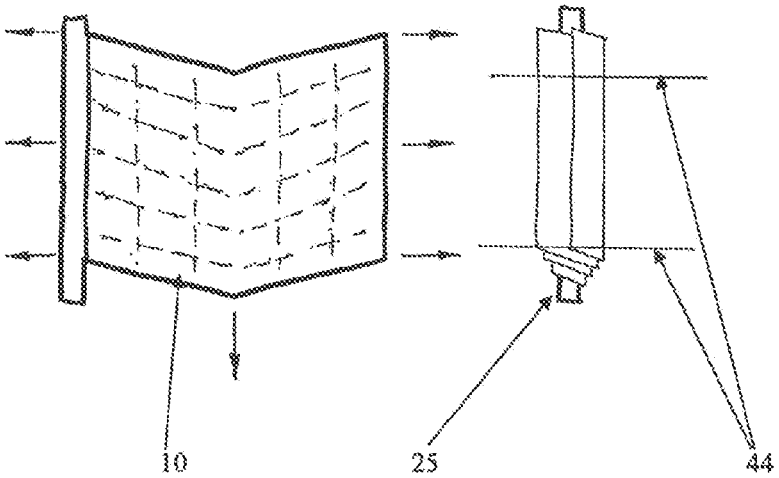

Referring to FIG. 26, it is also possible to attach the mesh material 10 to a rod member 25, then to pull the mesh material as illustrated to create an approximate desired shape, then to roll the mesh material onto the rod member 25 while still under tension and then to cut through both the mesh material and the rod member (or just the mesh material) while the fabric is wound about the rod member (see cut lines 44). It is also possible to cut the fabric with a pair of stationery blades as the fabric is being wound up onto the rod member.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

It should be appreciated that various other changes and modifications can be made to any embodiment described without departing from the spirit and scope of the invention.

The invention claimed is:

1. A window or door opening screen assembly, the assembly comprising:

a flexible screen material having opposed substantially parallel side edges and an upper and lower edge;

a first at least substantially rigid edge member to which one opposed side edge of the screen material is attached;

a second at least substantially rigid edge member to which the other side edge of the screen material is attached, the screen material able to be wound onto and off the second edge member, wherein the substantially first and second rigid edge members are positioned substantially parallel to one another during use;

a tensioner to tension the screen material; and wherein one of the upper and lower edges of the screen material is provided with a convex shape and the other of the upper and lower edges is provided with a concave shape such that the upper and lower edges of the screen material are adapted to match the Catenary effect that exists in the screen material when the screen is positioned in a substantially vertical plane and in tension under the effect of gravity.

2. The assembly of claim 1 wherein each shape of the upper and lower edges comprises a curve.

3. The assembly of claim 1 wherein the tensioner comprises an elastomeric member.

4. The assembly of claim 1 further comprising a tension equalizer to distribute tension equally throughout the flexible screen material.

5. The assembly of claim 1 wherein:

the upper edge of the screen material is provided with a convex shape; and the lower edge of the screen material is provided with a concave shape.

6. A window or door opening screen assembly, the assembly comprising:

a flexible screen having a first side edge opposite a second side edge, the first and second side edges being substantially parallel, the flexible screen having an upper edge opposite a lower edge;

a support secured to the first side edge of the flexible screen in a configuration to allow the flexible screen to be selectively rolled on and off the support, the support comprising a first rigid edge member;

a second rigid edge member secured to the second side edge of the flexible screen, the first and second rigid edge members are positioned substantially parallel to each other and configured to be substantially parallel when the flexible screen is selectively rolled on and off the support; and wherein one of the upper and lower edges of the screen material is provided with a convex shape and the other of the upper and lower edges is provided with a concave shape such that the upper and lower edges of the screen material are adapted to match the Catenary effect that exists in the screen material when the screen is positioned in a substantially vertical plane and in tension under the effect of gravity.

7. The assembly of claim 6 wherein the shape configuration of the flexible screen comprises at least one of the upper and lower edges having a curved shape.

8. The assembly of claim 6 further comprising a tension equalizer to distribute tension equally throughout the flexible screen.

9. The assembly of claim 6 further comprising a tensioner to tension the flexible screen, the tensioner comprising an elastomeric member.

10. The assembly of claim 6 wherein:

the upper edge of the flexible screen is provided with a convex shape; and the lower edge of the flexible screen is provided with a concave shape.

11. A window or door opening screen assembly, the assembly comprising:

a flexible screen having a first side edge opposite a second side edge, the first and second side edges being substantially parallel, the flexible screen having an upper edge opposite a lower edge;

a support secured to the first side edge of the flexible screen in a configuration to allow the flexible screen to be selectively rolled on and off the support, the support comprising a first rigid edge member;

a second rigid edge member secured to the second side edge of the flexible screen, the first and second rigid edge members are positioned substantially parallel to each other and configured to be substantially parallel when the flexible screen is selectively rolled on and off the support;

a tension equalizer to distribute tension equally throughout the flexible screen; and wherein one of the upper and lower edges of the screen material is provided with a convex shape and the other of the upper and lower edges is provided with a concave shape such that the upper and lower edges of the screen material are adapted to match the Catenary effect that exists in the screen material when the screen is positioned in a substantially vertical plane and in tension under the effect of gravity.

12. The assembly of claim 11 wherein the shape configuration of the flexible screen comprises at least one of the upper and lower edges having a curved shape.

13. The assembly of claim 11 further comprising a tensioner to tension the flexible screen, the tensioner comprising an elastomeric member.

14. The assembly of claim 11 wherein:

the upper edge of the flexible screen is provided with a convex shape; and the lower edge of the flexible screen is provided with a concave shape.

* * * * *